United States Patent [19]

Asano et al.

[11] Patent Number: 4,592,297

[45] Date of Patent: Jun. 3, 1986

[54] NEEDLE CENTERING DEVICE AND CUTTER FOR A ZIG-ZAG SEWING MACHINE

[75] Inventors: Satoru Asano; Shigeru Abe, both of Aichi, Japan

[73] Assignee: Brother Kogyo Kabushiki Kaisha, Nagoya, Japan

[21] Appl. No.: 774,479

[22] Filed: Sep. 10, 1985

[30] Foreign Application Priority Data

Sep. 10, 1984 [JP] Japan ..... 59-189100

[51] Int. Cl.[4] ..... D05B 65/02; D05B 3/02

[52] U.S. Cl. ..... 112/443; 112/291

[58] Field of Search ..... 112/291, 292, 443

[56] References Cited

U.S. PATENT DOCUMENTS

| | | | |
|---|---|---|---|
| 2,376,417 | 5/1945 | Chudner | 112/291 |
| 2,914,010 | 11/1959 | Cohen | 112/291 |
| 3,194,198 | 7/1965 | Chudner | 112/291 X |
| 3,709,176 | 1/1973 | Papajewski et al. | 112/292 |

*Primary Examiner*—Werner H. Schroeder
*Assistant Examiner*—Andrew M. Falik
*Attorney, Agent, or Firm*—Finnegan, Henderson, Farabow, Garrett & Dunner

[57] ABSTRACT

A mechanism for trimming the thread on a sewing machine with a laterally oscillating needle has devices for shifting the amplitude of needle oscillation to a center or zero position and for cutting both needle and bobbin threads. Thread connected to a workpiece is easily cut by actuation of the shift device to move the needle to the center position at which time the thread cutting device is actuated to cut the sewing machine needle and bobbin threads.

5 Claims, 12 Drawing Figures

NEEDLE CENTERING DEVICE AND CUTTER FOR A ZIG-ZAG SEWING MACHINE

BACKGROUND OF THE INVENTION

1. Field of the Invention

This invention relates to sewing machines and, more particularly, to sewing machines with needle oscillating mechanisms.

2. Description of the Related Art

Sewing machines are known to incorporate laterally oscillating needles for obtaining different stitch patterns as, for example, a zigzag stitch. An example of a sewing machine with such a mechanism is the subject of U.S. Pat. No. 3,443,538 issued to E. D. Wulbrede et al.

Sewing machines are also known to incorporate thread trimming mechanisms in the machine underbed for trimming needle and bobbin threads with scissor-type thread cutters. An example of a sewing machine with such a cutter is the subject of U.S. Pat. No. 3,709,176 issued to Papajewski et al.

In sewing machines with laterally oscillating needles, the needle moves to the left and to the right to form a zigzag stitch seam. Upon completion of the seam, the needle position is not uniform for accurate thread handling, catching and cutting. Because oscillating needle machines in the related art do not have a uniform needle position for thread cutting, there is a risk of erroneous thread cutting. Additionally, when threads are cut, there is a problem that the remaining amount of thread connected to the work piece after thread cutting cannot be made uniform.

It is an object of the present invention to overcome the above-identified problems associated with automatic thread trimming mechanisms on oscillating needle sewing machines.

SUMMARY OF THE INVENTION

In order to achieve the above object, the present invention provides a mechanism for shifting an oscillating sewing machine needle to the zero oscillation position when the sewing machine thread is cut. The sewing machine is characterized by a base and/or arm on the base. An oscillating means in the arm applies transverse motion to the needle. The transverse motion is orthogonal to the direction in which the work piece is fed into the machine. The invention is further embodied by a thread cutting means in the sewing machine base. As the thread cutting means cuts the sewing machine thread, a shift means shifts the needle to a zero or center position where it is neither positioned to the left nor the right.

DESCRIPTION OF THE PREFERRED EMBODIMENT

Figure 1:
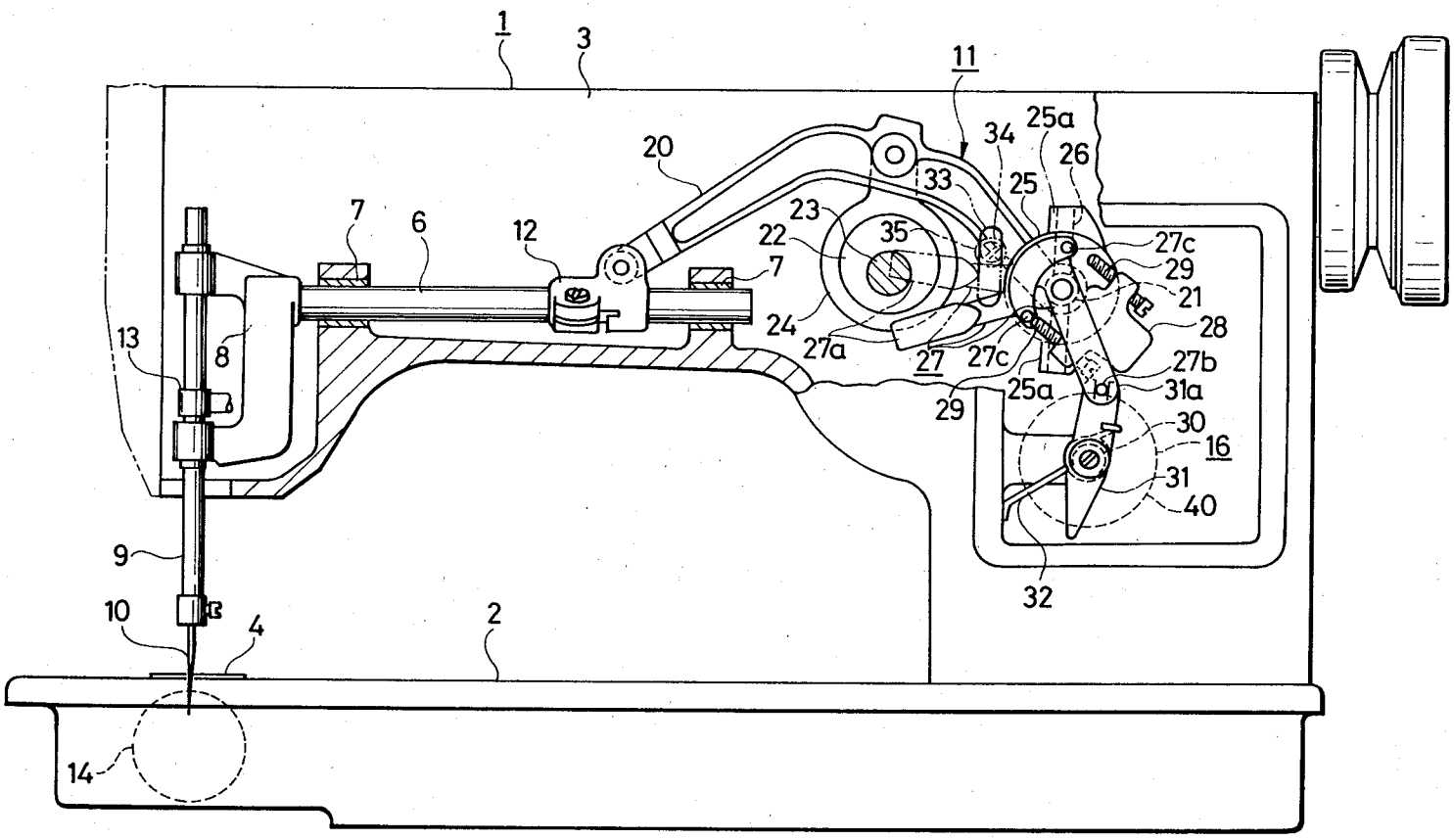
FIG. 1 is a partially broken-away front view of a zigzag sewing machine showing a needle oscillating mechanism and a needle oscillation shift means.

With reference to the accompanying drawings, the present invention will be explained in one embodiment in which the invention is embodied in a zigzag sewing machine.

In this embodiment, as shown in FIGS. 1, 2, 5 and 6, a machine frame 1 is composed of a bed 2 and an arm 3. On bed 2 a slide plate 5 is set and a throat plate 4 is formed with a needle aperture 4*a* therein. In the inside of the arm 3, a slide shaft 6 is slidably supported by a pair of metal bearings 7 so as to be movable to the left and the right. The shaft 6 is attached at its front end to a needle bar gate 8 which supports needle bar 9 that is movable up and down. The needle bar 9 is attached to a needle 10 therebelow.

Figure 2:
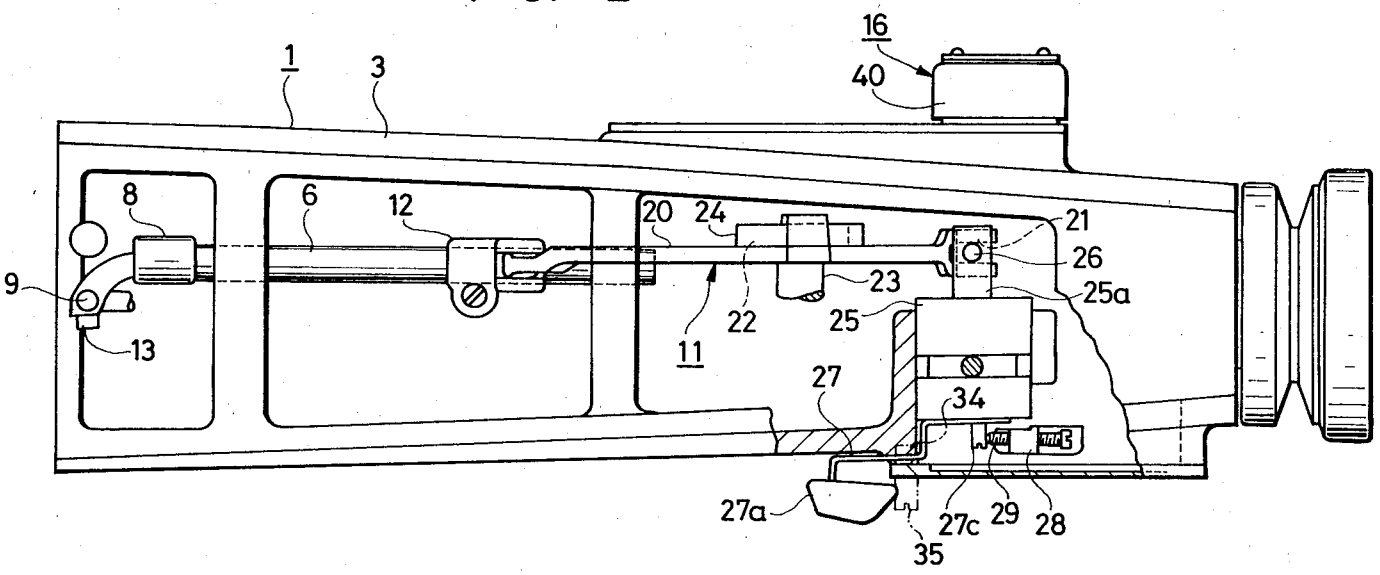
FIG. 2 is a partially broken-away top view of the machine of FIG. 1 with the upper lid being removed therefrom.
Figure 3:
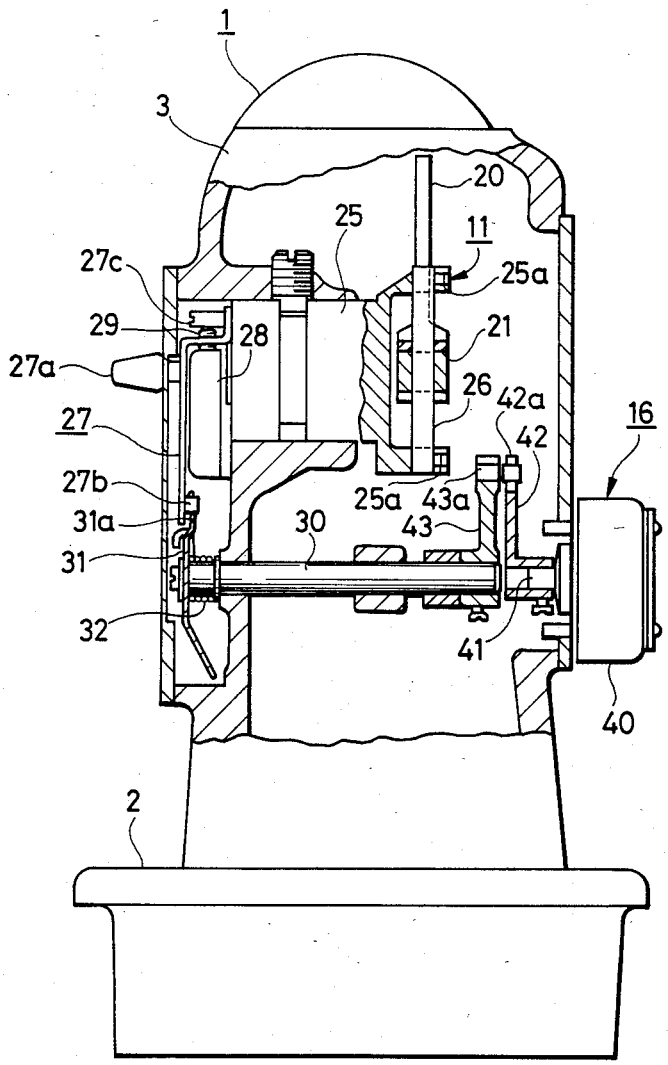
FIG. 3 is a partially broken-away side view of the machine of FIG. 1.

As shown in FIGS. 1–3, a needle oscillating mechanism 11 inside of the arm 3 applies transverse movement, orthogonal to the feed direction of a work piece, to the needle 10 through a connector 12 on the slide shaft 6. Vertical reciprocating movement is applied to the needle 10 from a needle actuating mechanism (not shown) through a needle clamp 13. The needle 10, in cooperation with a loop taker 14 disposed in the bed 2, forms a lock stitch seam of sewing thread consisting of upper and lower threads in the work piece on the throat plate 4.

Figure 5:
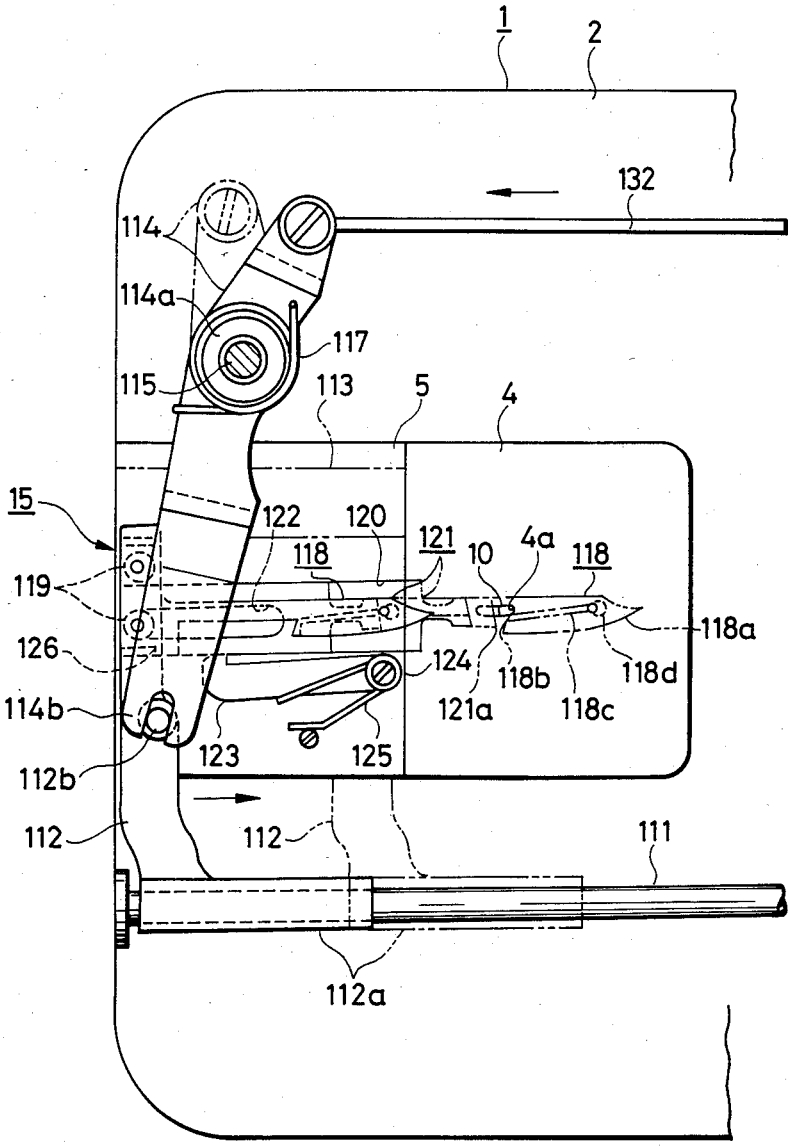
FIG. 5 is a bottom view of a portion of the base of the sewing machine frame of FIG. 1 illustrating the thread cutting device contained therein.
Figure 6:
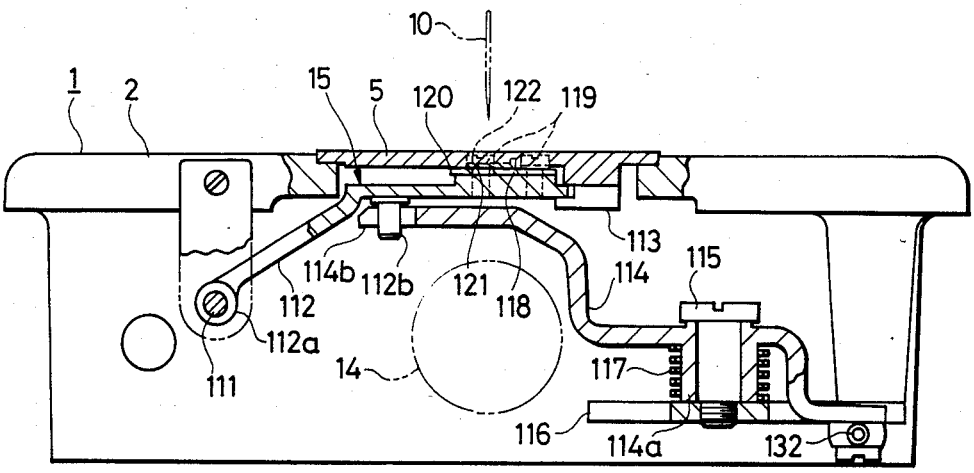
FIG. 6 is a partially broken-away side view of the machine frame base portion of FIG. 5.

Further, as shown in FIGS. 5 and 6, a thread cutting device 15 is disposed in the bed 2 below the slide plate 5, which is adapted to cut a thread connected to the work piece. Further, as shown in FIGS. 1–3, a shift means 16, for shifting the amplitude of needle oscillation, is disposed in the arm 3 adjacent to the above-mentioned needle oscillating mechanism 11. Upon operation of the thread cutting device 15, the needle oscillating mechanism 11 is shifted by the shift means 16, to be temporarily set at the zero amplitude or center position of needle oscillation.

The needle oscillating mechanism 11 will first be explained in detail. Referring to FIGS. 1–3, a connecting rod 20 is rotatably attached at its one end to the connector 12 on the slide shaft 6, and has at its other end a bifurcated part to which an adjusting piece 21 is rotatably connected. An eccentric cam 22 is rotatably supported by means of a rotary shaft 23 inside of the arm 3 below the connecting rod 20. A ring 24 embracing the eccentric cam 22 is rotatably connected to substantially the middle part of the connecting rod 20. When the eccentric cam 22 is rotated in connection with the main shaft (not shown) of the sewing machine, swinging motion is exerted on the connecting rod 20 by the ring 24.

An adjusting member 25 is rotatably connected to the arm 3 in front of the bifurcated end of the connecting rod 20. An adjusting pin 26, which pierces the adjusting piece 21, extends between a pair of supporting arms 25*a* projecting from the rear surface of the adjusting member 25. Accordingly, when the above-mentioned connecting rod 20 is swung by means of the eccentric cam 22, the adjusting piece 21 is moved up and down along the adjusting pin 26 so that transverse movement is exerted on the connector 12 at the other end of the connecting rod 20 in accordance with the inclined condition of the adjusting pin 26.

A control member 27 secured to the front surface of the adjusting member 25 is provided at its one end with a control knob 27*a* which projects outside the front surface of the arm 3. The control member 27 is also projectingly provided at its other end inside the arm 3 with an actuating pin 27*b* and with a pair of engaging pins 27*c* being projected from the front surface of the intermediate section of the control member 27. A limiting member 28 is disposed inside the arm 3 adjacent to the control member 27. It has two side parts in which a pair of limiting screws 29 are adjustably screwed so that the screws 29 engage the engaging pins 27*c* on the control member 27 to limit the rotating range of the adjusting member 25.

As shown in FIGS. 1 and 3, below the adjusting member 25, a rotary shaft 30 is rotatably supported inside of the arm 3, which is secured at its front end to an actuating lever 31 whose upper bifurcated part 31*a* is engaged with the actuating pin 27*b* on the control member 27. Further, this actuating lever 31 is rotatingly urged in the counterclockwise direction (as shown in FIG. 1) by a spring 32 so that the control member 27 and the adjusting member 25 are rotatingly urged in the clockwise direction (as shown in FIG. 1). Because the adjusting member 25 is biased in the clockwise direction, the adjusting pin 26 is biased toward a tilted position where the amplitude of needle oscillation is at a maximum.

Figure 4:
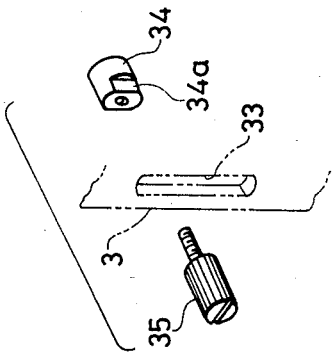
FIG. 4 is a partially enlarged perspective view of the machine of FIG. 1 wherein the engaging member and a setting knob are disassembled.

As shown in FIGS. 1, 2 and 4, a vertically extending elongated hole 33 is formed in the front surface of the arm 3 in the vicinity of the control member 27*a* on the left side thereof. An engaging member 34 with a front end fitting part 34*a* is fitted in the elongated hole 33. The engaging member 34 is movable in the vertical direction so that it is engaged with the control member 27*a*. The engaging member 34 is adapted to be set at a predetermined position by means of a setting knob 35 disposed at the front of the elongated hole 33 and threadedly engaged with the engaging member 34. Accordingly, as shown by the broken line in FIG. 1, the control member 27*a* is normally biased toward the engaging member 34 by the spring 32. The adjusting member 25, which supports the adjusting pin 26, is thereby maintained in a position such that the amplitude of needle oscillation is set in accordance with the set position of the engaging member 34.

The shift means 16 will be described with reference to FIGS. 1–3. A rotary solenoid 40 is attached to the right surface of the arm 3 (as shown in FIG. 3) in axial alignment with rotary shaft 30. The solenoid 40 has its output shaft 41 secured to rotary shaft 30 by a drive lever 42 having at its upper end a bifurcated part 42*a*. Opposing the drive lever 42, a driven lever 43 is secured to the right end of the rotary shaft 30 (as shown in FIG. 3). From the right surface of the upper end of the driven lever 43 is projected a pin 43*a* which engages the bifurcated part 42*a* of the drive lever 42.

When a thread cutting signal is issued in association with, for example, operation of a foot pedal (not shown), the rotary solenoid 40 is energized to rotate the drive lever 42 so that the control member 27 is rotated by way of the driven lever 43, the rotary shaft 30 and the actuating lever 31 from the position shown by the broken line in FIG. 1 to the position shown by the solid line. The above sequence shifts the adjusting member 25 which carries the adjusting pin 26 temporarily to the position of zero needle oscillation amplitude.

The thread cutting device 15 disposed below the slide plate 5 is described with reference to FIGS. 5 and 6. In the machine bed 2, below and to the rear of the shuttle race slide 5, a guide rod 111 is mounted extending in the lateral direction. A sliding member 112 with a cylindrical part 112*a* (as shown in FIG. 6) is slidably fitted on the guide rod 111. The other end of the sliding member 112 is extended along the lower surface of the slide plate 5 and is held by a guide plate 113 which is connected to the lower surface of the slide plate 5.

In front of the slide plate 5, an actuating lever 114 is rotatably supported at its intermediate boss part 114*a* by means of a stepped bolt 115 mounted inside the machine bed 2 on an attaching plate 116. One end of the lever 114 is formed with a bifurcated part 114*b* which is engaged with a pin 112*b* on the lower surface of the sliding member 112. Further, this actuating lever 114 is urged in the counterclockwise direction (as shown in FIG. 5) by a spring 117 fitted on the boss part 114*a* biasing the sliding member 112 to the right (as shown in FIG. 5).

As shown in FIGS. 5 and 6, a movable blade 118 is secured at its base end to the top surface of the front end of the sliding member 112 by means of a pair of screws 119. The blade 118 moves in tandem with the movement of the sliding member 112 between the left original position (shown by the solid line in FIG. 5) and the right thread catching position (shown by the broken line in FIG. 5). Further, at the front end of the movable blade 118, there is provided a thread processing part 118*a* which enters into the loop of an upper thread of the sewing thread Y connected to the work piece. In association with forward movement of the movable blade 118 toward the thread catching position, there is further provided a thread catching part 118*b* for catching the part of the upper thread loop extending to the work fabric and the lower thread. In association with the return movement of the movable blade 118, there is further provided a thread introduction groove 118*c* for introducing the thus caught threads Y to a cutting surface 118*d* for cutting the introduced threads Y.

A stationary blade 121 under the movable blade 118 is fitted in and supported by a guide groove 120 in the slide plate 5 so that the blade 121 is movable between its operating position in the vicinity of the reciprocating path of the needle (as shown by the broken line in FIG. 5), and its rest position which is laterally withdrawn therefrom (as shown in the solid line in FIG. 5). At the front end of the stationary blade 121 is formed a cutting edge 121*a* (shown in FIG. 8) which cooperates with the cutting surface 118*d* of the movable blade 118 to cut the sewing threads Y. The head of one of the screws 119 on the movable blade 118 is fitted in a laterally extending enlongated hole 122 which is formed in the base end of the stationary blade 121. Upon forward movement of the movable blade 118 toward the thread catching position, the head of the screw 119 engages the end of the elongated hole 122 in the later part of the forward movement (as shown in FIG. 8(*b*)). Following engagement, the stationary blade 121 is moved by blade 118 to the operating position in the vicinity of the reciprocating path of the needle. Upon return movement of the movable blade 118 toward its original position, the head of the screw 119 engages the other end of the elongated hole 122 during the later part of the return movement as shown in FIG. 8(*e*). Following engagement, that stationary blade 121 is moved to its rest position by the movable blade 118.

In the vicinity of the stationary blade 121, a latch member 123 is rotatably connected to the lower surface of the slide plate 5 by means of a stepped screw 124. The latch member 123 is biased by spring 125 in a clockwise direction (as shown in FIG. 5). For associating with the front end of the latch member 123, a stepped latch part 126 is formed in the rear part of the base end of the stationary blade 121 such that the latch member 123 engages this stepped latch part 126 when the stationary blade 121 is moved to the operating position as shown in FIG. 8(*c*). Upon the return movement of the movable blade 118, movement of the stationary blade toward the rest position is inhibited (FIG. 8(*c*)). An inclined releasing surface 127 is formed in the rear part of the base end of the movable blade 118 so that the inclined releasing surface 127 engages the front end of the latch member 123 during the later part of the return movement of the movble blade 118 to rotate the latch member 123 away from the stepped latch part 126 in a counterclockwise direction (as shown in FIG. 8(*d*)).

Figure 7:
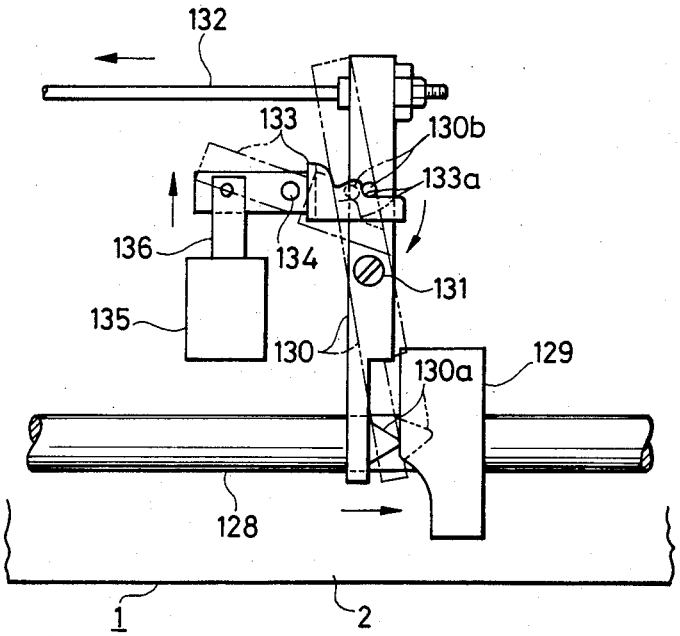
FIG. 7 is a bottom view of a portion of the machine frame of FIG. 1 illustrating an operational component in section of the thread cutting device.
Figure 8A:
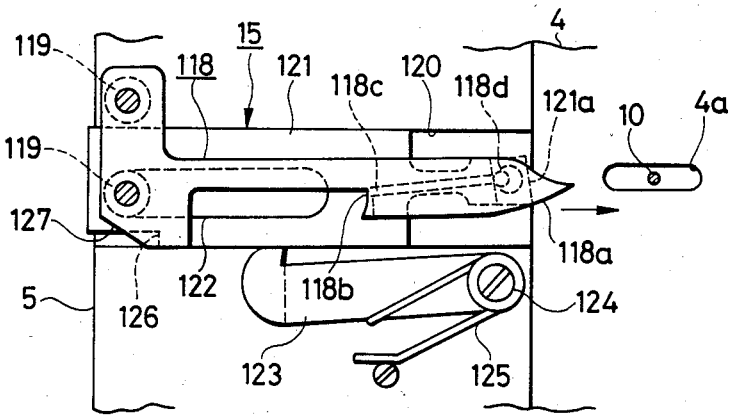
FIGS. 8(*a*)–(*e*) are partially enlarged bottom views of the thread cutting device of FIG. 7 illustrating the operational steps of the device in order.
Figure 8B:
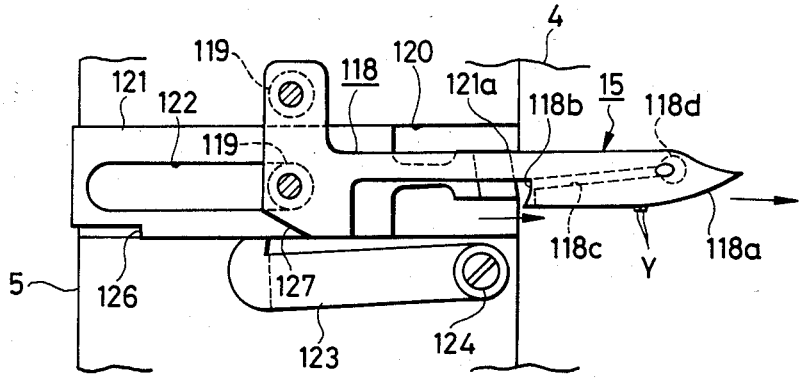
Figure 8C:
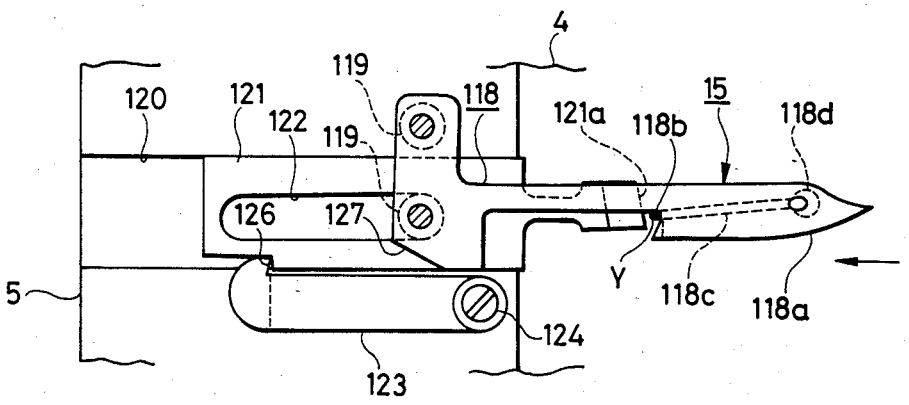
Figure 8D:
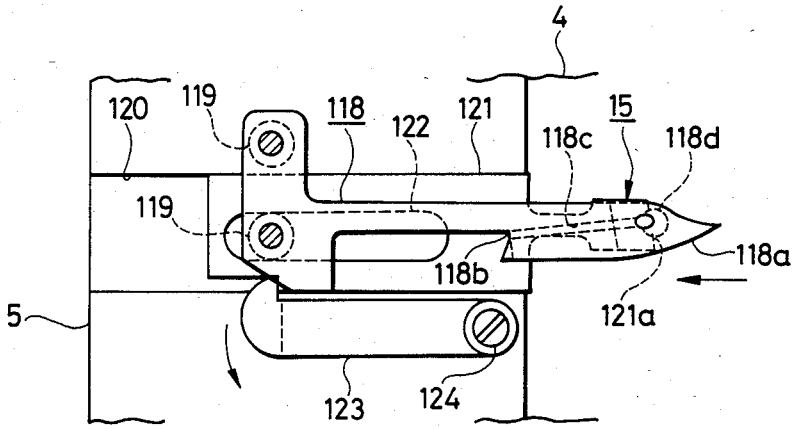
Figure 8E:
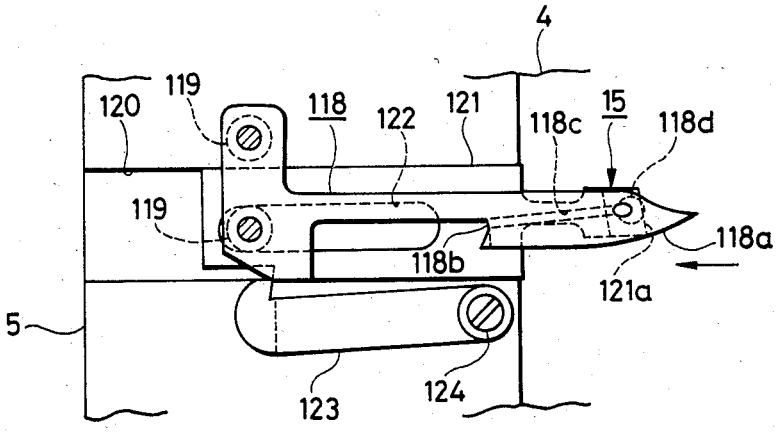

As shown in FIG. 7, in the lower section of the bed 2 of the machine frame 1 a thread cutting control cam 129 is secured to a lower shaft 128. In association with the cam 129, a follower lever 130 is rotatably connected to the lower surface of the bed 2 by means of a stepped screw 131. An engaging projection 130*a* is formed at one end of lever 130 which engages the cam 129. A connecting rod 132 is disposed between the other end of the follower lever 130 and the front end of the actuating lever 114. Under action of the spring 117 set on the actuating lever 114, the connecting lever 132 rotatingly biases the follower lever 103 in the counterclockwise direction (as shown in FIG. 7) so that the engaging projection 130*a* normally engages the cam 129.

In the vicinity of the follower lever 130, an inhibiting member 133 is rotatably supported at its intermediate part to the lower surface of the bed 2 by means of a support shaft 134. The inhibiting member 133 has a bifurcated part at its one end which is formed with a stepped engaging part 133*a* for engaging pin 130(*b*) on the follower lever 130 for inhibiting the rotation of the follower lever 130 and preventing it from following the above-mentioned cam 129. In the vicinity of the inhibiting member 133, a solenoid 135, arranged on the lower surface of the bed 2, has an armature 136 whose front end is coupled to the other end of the inhibiting member 133. Further, when this solenoid 135 is energized by a thread cutting signal issued under the depression of a foot pedal (not shown), the inhibiting member 133 is rotated clockwise to the releasing position (as shown by the broken line in FIG. 7) so that it releases from the pin 130(*b*) on the follower lever 130. Upon release of the follower lever 130, the lever 130 follows the cam and rotates through the position indicated by the broken line in FIG. 7.

In the sewing machine of this embodiment, the rotary solenoid 40 in the shift means 16 (shown in FIGS. 1–3) is normally de-energized so that the control member 27 of the needle oscillating mechanism 11 is biased by the spring 32 to engage the engaging member 34 (as shown by the broken line in FIG. 1). The adjusting member 25, carrying the adjusting pin 26, is thus rotated to and set at the needle oscillation amplitude position corresponding to the set position of the engaging member 34.

When solenoid 40 is de-energized, the solenoid 135 in the thread cutting device 15 (shown in FIGS. 5–7) is also de-energized so that the follower lever 130 is inhibited from rotating by the inhibiting member 133 (as shown by the solid line in FIG. 7). The actuating lever 114 is thus held in one position (as shown by the solid line in FIG. 5) overcoming the action of the spring 117, which holds the sliding member 112 at the end of the guide rod 111 so that the movable blade 118 is in the position laterally withdrawn from the path of the needle. Stationary blade 121 is also positioned at the rest position where it is overlapped by the movable blade 118. In this arrangement, the needle oscillating mechanism 11 applies transverse motion orthogonal to the work piece feed direction to the needle 10, while the needle operating merchanism (not shown) applies vertical reciprocating motion to the same needle 10. A sewing seam is thus formed on the work fabric by the needle 10 in cooperation with the loop taker 14. Because there is no risk that the needle or the work fabric feed dog will interfere with the movable and stationary blades 118, 121, respectively, of the thread cutting device 15, sewing work can be smoothly carried out.

In order to cut a thread after a predetermined operation is completed, the rotary solenoid 40 in the shift means 16 (shown in FIGS. 1–3) is energized, while the solenoid 135 in the thread cutting device 15 (shown in FIG. 7) is simultaneously energized. The drive lever 42 is rotated upon the energization of the rotary solenoid 40 so that the control member 27 is rotated by way of the driven lever 43, the rotary shaft 30 and the actuating lever 31 from the position indicated by the broken line in FIG. 1 to the position indicated by the solid line. The adjusting member 25, carrying the adjusting pin 26, is thereby shifted to be set temporarily at the needle oscillation zero amplitude position.

Meanwhile, the energization of the solenoid 135 of the thread cutting device 15 rotates the inhibiting member 133 away from the pin 130*b* on the follower lever 130 to the releasing position indicated by the broken line in FIG. 7. When the needle 10 is positioned in the vicinity of the upper surface of throat plate 4, the indented cam surface of the cam 129 on the lower shaft 128 is opposed to the engaging projection 130*a* on the follower lever 130. Therefore, the follower lever 130 and the actuating lever 114, integrally connected through the rod 132, are rotated under action of spring 117 in the counterclockwise direction (as shown in FIGS. 5 and 7). The actuating lever 114 moves the sliding member 112 from the position indicated by the solid line in FIG. 5 in the direction of the arrow thereby moving the movable blade 118 from the original position (as shown in FIGS. 5 and 8(*b*)) to the thread catching position.

With the forward movement of the movable blade 118, the thread processing part 118*a* of the movable blade 118 enters through the thread loop of the upper thread of the sewing thread Y which is connected to the work fabric. Simultaneously, the head of one of the screws 119 on the movable blade 118 engages the end of the elongated hole 122 on the stationary blade 121 thereafter moving the stationary blade 121 from the rest position to the operating position in the vicinity of the reciprocating path of the needle. Further, as shown in FIG. 8(*c*), the stationary blade 121 is positioned at the operating position such that the movable blade 118 has moved it to its extreme forward position where the latch member 123, engages the stepped latch part 126 of the stationary blade 121 under action of the spring 125, locking the stationary blade 121 in the operating position.

The lower shaft 128, then rotates to the position where the thicker cam surface of the cam 129 is opposed to the projection 130*a* of the follower lever 130. The follower lever 130 and the actuating lever 114 are rotated integrally together in a clockwise direction from the position indicated by the broken line (as shown in FIGS. 5 and 7). This initiates the return movement of the sliding member 112 from the position indicated by the broken line in FIG. 5 and the movable blade 118 is returned from the thread catching position as indicated in FIG. 8(*c*). After the movable blade 118 begins its return, the thread catching part 118*b* of the movable blade 118 catches up the part of the upper thread 1oo0 extending to the work fabric and the lower thread (as shown in FIG. 8(*c*)).

The sewing threads Y, consisting of the upper and lower threads, are then introduced in the thread introducing groove 118(*c*) and led to the cutting surface 118(*d*) as the movable blade 118 makes it return movement. The sewing threads Y are cut right below the reciprocating path of the needle by the cooperation between the cutting surface 118(*d*) and the cutting edge 121*a* of the stationary blade 121 set at the operating position (as shown in FIG. 8(*d*)). Accordingly, the length of the remaining thread on the work fabric side may be made short and uniform making it is completely unnecessary to pick off the remaining thread. After the sewing thread Y is cut by the movable blade 118, with the adjusting member 25 in the needle oscillating mechanism 11 still set at the needle oscillation zero amplitude position, the needle 10 is raised at its zero position. The above-mentioned processing and catching of the sewing threads Y may accordingly be stably and surely made so that the sewing thread Y may be surely cut with no risk of erroneous cutting.

After cutting, the inclined releasing surface 127 on the movable cutter 118 engages the front end of the latch member 123 rotating it away from the stepped latch part 126 of the stationary blade 121 (as shown in FIGS. 8(*d*) and 8(*e*)). The stationary blade 118 is thereby released from its latched condition. When the movable blade 118 is moved beyond the position shown in FIG. 8(*e*) in the return direction, the head of one of the screws 119 on the movable blade 118 engages the other end of the elongated hole 122 of the stationary blade 121. The continued return movement of the movable blade 118 retracts the stationary blade 121 from the operating position to the rest position. The movable and stationary blades 118, 121 are integrally moved so that the movable blade 118 is set at the original position and the stationary blade 121 is set at the rest position (as shown in FIG. 8(*a*)).

The pin 130*b* on the follower lever 130 then engages the stepped engaging part 133*a* of the inhibiting member 133 (as shown by the solid line in FIG. 7) to restrain the movement of the blades 118 and 121. Thus, the cutting operation of the sewing thread Y is completed.

It is noted that the present invention is not limited to the arrangement of the above-mentioned embodiment, and the structure of each part may be variously and specifically modified without departing the spirit and scope of the present invention.

What is claimed is:

1. A zigzag sewing machine comprising:

a frame including an arm and a bed;

a needle carried by said arm for endwise reciprocation and lateral movement;

oscillating means in said arm for applying said lateral movement to said needle;

a loop taker carried on said bed and forming a seam on a work fabric cooperating with said needle;

thread cutting means carried on said bed; and shift means for shifting said oscillating means to set the amplitude of said lateral movement in a zero position upon operation of said thread cutting means.

2. A sewing machine as recited in claim 1, wherein said oscillating means comprises:

a rod mounted in said arm having a first end, a second end and a midsection;

an oscillating shaft slidably mounted in said arm, said shaft connecting said first rod end to said needle;

an adjusting pin mounted in said arm, said pin being slidably connected to said second end of said rod;

means for repetitively displacing said midsection of said rod in a vertical direction substantially orthogonal to said rod; and control means for adjusting the angle of said adjusting pin wherein changing said angle changes the distance said first rod end is horizontally displaced.

3. A sewing machine as recited in claim 2 wherein said control means biases said adjusting pin toward a position of maximum horizontal first rod end displacement.

4. A sewing machine as recited in claim 3, wherein said shift means comprises:

a solenoid mounted in said frame, said solenoid being adapted to actuate said control means to move said adjusting pin from said biased position of maximum horizontal first rod end displacement to a position of zero horizontal first rod end displacement.

5. A zigzag sewing machine comprising:

a frame including an arm and a bed;

a rod mounted in said arm having a first end, a second end and a midsection;

an oscillating shaft slidably mounted in said arm, said shaft being connected to said first rod end;

a needle carried by said arm for endwise reciprocation and lateral movement;

an adjusting pin mounted in said arm, said pin being slidably connected to said second end of said rod;

means for repetitively displacing said midsection of said rod in a vertical direction substantially orthogonal to said rod;

control means for adjusting the angle of said adjusting pin wherein changing said angle changes the distance said first rod end is horizontally displaced;

biasing means for biasing said adjusting pin toward a position of maximum horizontal first rod end displacement;

thread cutting means in said bed for cutting said thread; and a solenoid mounted in said frame, said solenoid being adapted to actuate said control means, upon operation of said thread cutting means, to move said adjusting pin from said biased position of maximum first rod end displacement to a position of zero horizontal first rod displacement.

* * * * *